US006038727A

United States Patent [19]

Chen

[11] Patent Number: 6,038,727

[45] Date of Patent: Mar. 21, 2000

[54] BATH BALL

[75] Inventor: Kuo-Chin Chen, Taipei, Taiwan

[73] Assignee: Confirm Personal Care Industrial Corp., Taiyuan Hsien, Taiwan

[21] Appl. No.: 09/287,580

[22] Filed: Apr. 6, 1999

[51] Int. Cl.[7] ..... A47K 7/02

[52] U.S. Cl. ..... 15/229.11; 15/209.1; 300/21

[58] Field of Search ..... 15/208, 209.1, 15/210.1, 229.11; 300/21

[56] References Cited

U.S. PATENT DOCUMENTS 5,465,452 11/1995 Girardot et al. ..... 15/229.11
5,727,277 3/1998 Chien ..... 15/229.11
5,727,278 3/1998 Per-Lee ..... 15/229.11

*Primary Examiner*—Randall E. Chin
*Attorney, Agent, or Firm*—Pro-Techtor International Services

[57] ABSTRACT

A bath ball is formed from multiple layers of superposed elastic nets woven out of artificial fibers. The elastic nets are axially compressed to produce a corrugated ring that is tightened at two diametrically opposite points with fastening means, such that outer peripheries of the corrugated ring automatically widely spread to form a loosely ruffled spherical body. The multiple layers of elastic nets have numerous overlapped meshes that define numerous small angular spaces to enable the bath ball formed from the elastic nets to produce more bubbles from reduced amount of cleansing product.

1 Claim, 4 Drawing Sheets

BATH BALL

BACKGROUND OF THE INVENTION

The present invention relates to a bath ball, and more particularly to a bath ball formed from multiple layers of elastic nets woven out of artificial fibers. Meshes on the elastic nets overlap one another to define numerous small angular spaces that enable the bath ball to produce more bubbles from reduced amount of cleansing product.

There are many kinds of body cleansing products available in the markets, including liquid soap, perfumed soap, etc. There are also different types of auxiliary cleaning devices, such as back brush, bath scrubber, bath ball, bath sponge, etc., suitable for working with the cleansing products to clean a user's body.

Among these body cleaning devices, the bath ball is usually formed from only one layer of elastic net woven out of artificial fibers. The elastic net is axially compressed to form a ring that is then tightened at two diametrically opposite points, so that other portions of the ring loosely spread from the tightened points to form a spherical bath ball. Such conventional bath ball is formed from only one single layer of elastic net and accordingly, has limited numbers of ruffles and usually one color. With limited numbers of ruffles, such conventional bath ball has poor ability of holding skin cleansing product and producing bubbles. The user might need to apply cleansing product over skin or the bath ball many times and extra amount of cleansing product would be consumed when taking a bath with such bath ball. This is, of course, inconvenient and not economical for the user.

It is therefore tried by the inventor to develop a bath ball that eliminates drawbacks existing in the conventional bath ball to provide improved cleaning effect.

SUMMARY OF THE INVENTION

A primary object of the present invention is to provide a bath ball that has increased ruffles and enhanced ability of producing more bubbles from reduced amount of cleansing product to achieve good cleaning effect.

To achieve the above and other objects, the bath ball of the present invention is produced from multiple layers of elastic nets woven out of artificial fibers. The elastic nets are sequentially put around a bar-like mold before they are axially compressing into a corrugated ring. The corrugated ring is tightening at two diametrically opposite points and then removed from the mold. At this point, outer peripheries of the corrugated ring distant from the tightened points automatically spread to form a spherical bath ball. The multiple layers of elastic nets have freely overlapped meshes that define numerous small, angular, and interlaced spaces in the corrugated ring and accordingly the spherical bath ball, giving the bath ball increased density, resilience, and softness and enhanced ability of producing more bubbles from reduced cleansing product.

BRIEF DESCRIPTION OF THE DRAWINGS

The above and other objects and the features and functions of the present invention may be best understood by referring to the following detailed description of the preferred embodiments and the accompanying drawings, wherein.

DETAILED DESCRIPTION OF THE PREFERRED EMBODIMENTS

Figure 1:
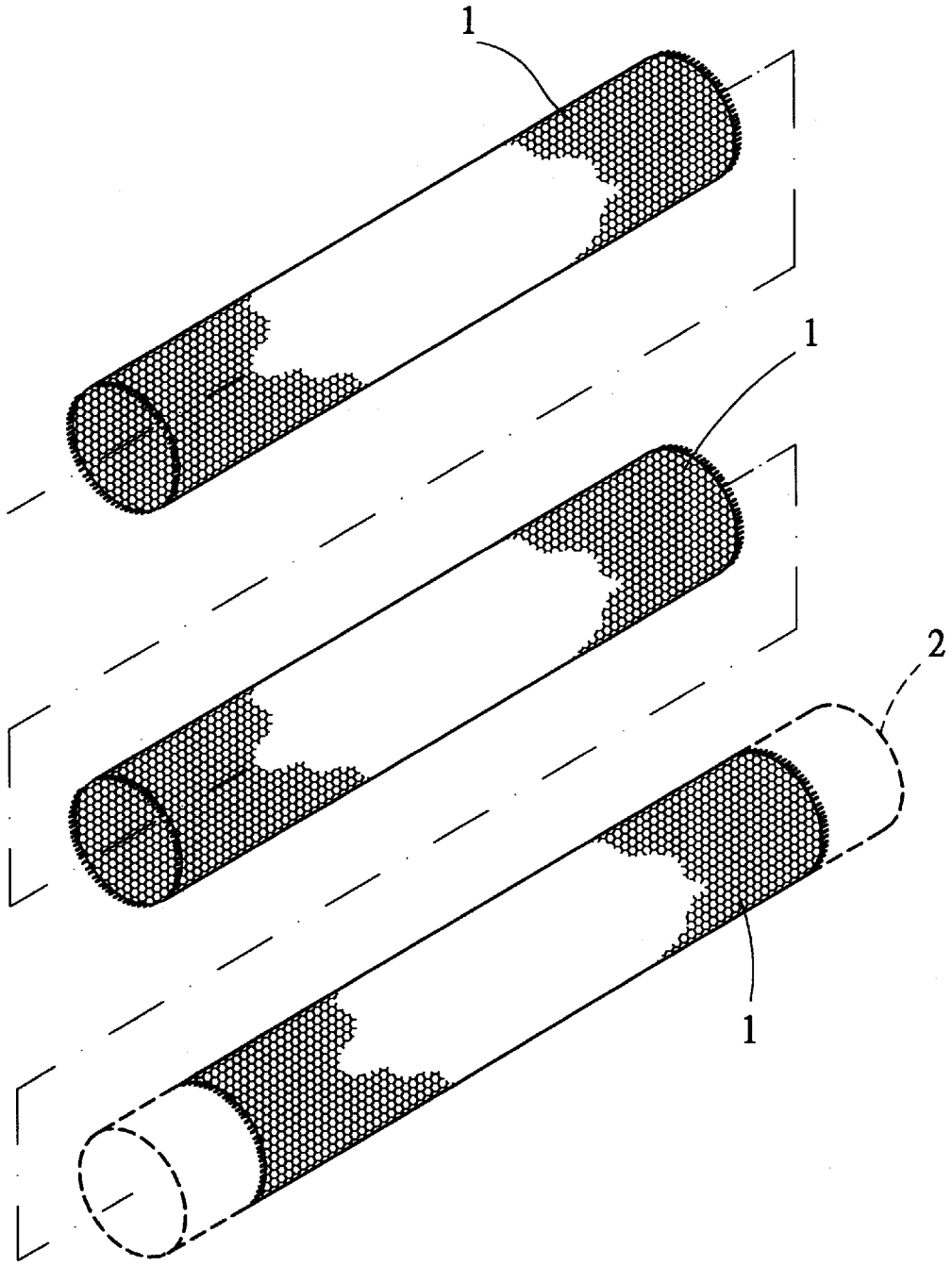
FIG. 1 illustrates multiple layers of elastic nets for forming the bath ball of the present invention are sequentially put around a bar-like mold.
Figure 2:
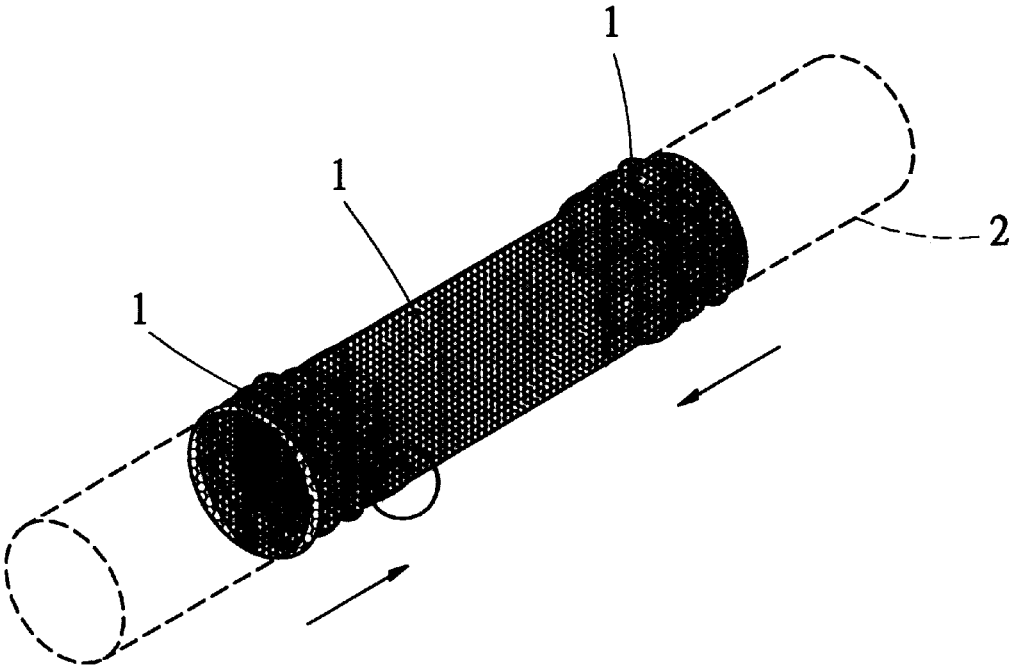
FIG. 2 illustrates the multiple layers of elastic nets around the mold are gradually axially compressed into a corrugated ring.
Figure 4:
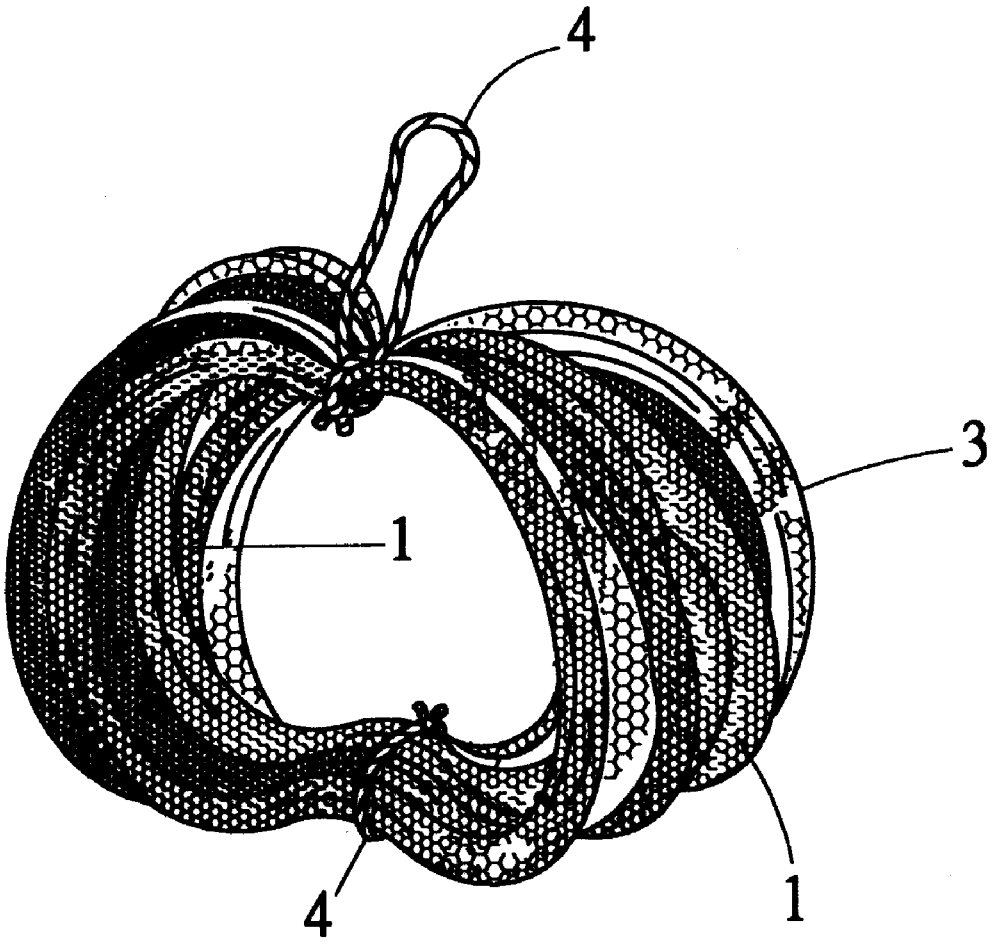
FIG. 4 shows the corrugated ring formed from FIG. 2 is removed from the mold and tightened at two diametrically opposite points with strings.
Figure 5:
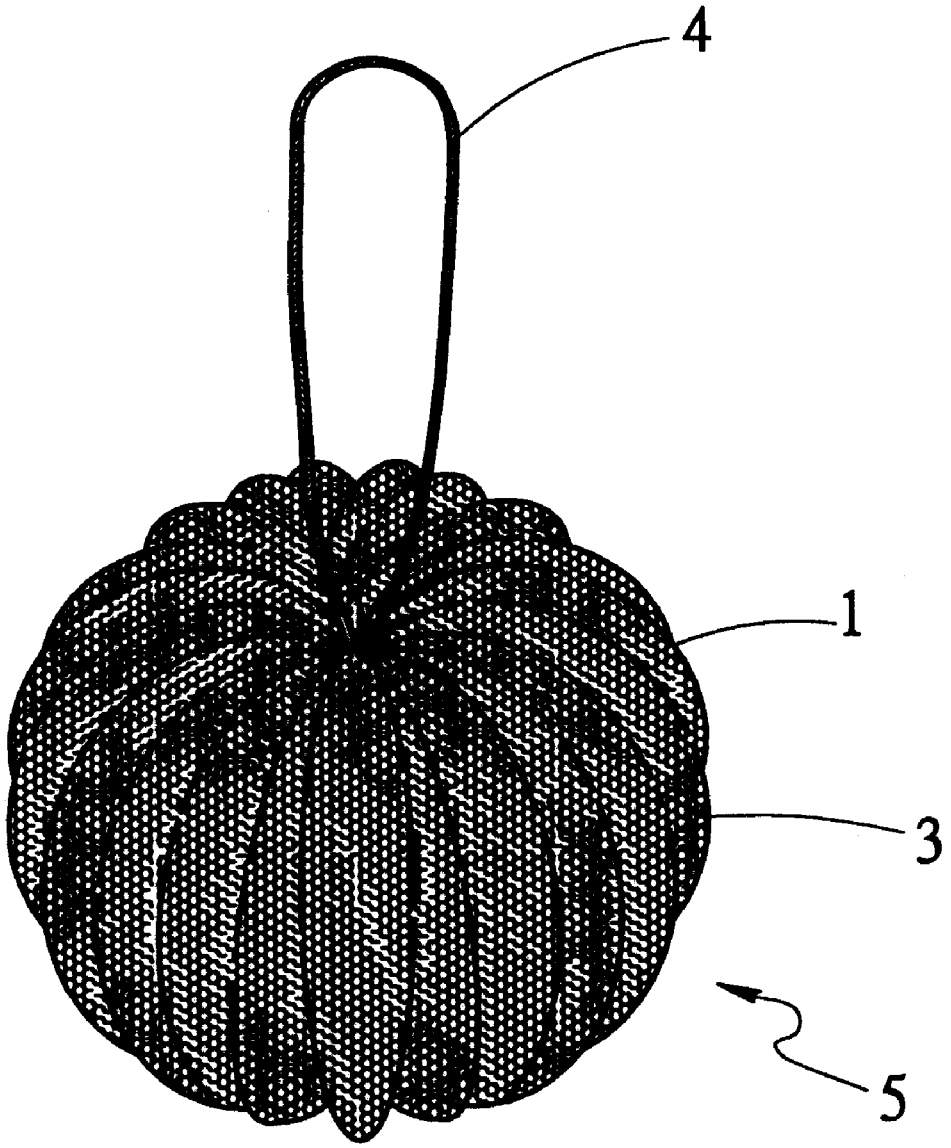
FIG. 5 is a perspective of a complete bath ball according to the present invention.

Please refer to FIGS. 1 and 2. The bath ball of the present invention includes multiple layers of elastic nets 1 that are woven out of artificial fibers and in a form of long sleeve. The elastic nets 1 are sequentially put around a bar-like mold 2, as shown in FIG. 1, so that each inner layer of elastic net 1 is covered by an outer layer of elastic net 1. Thereafter, the multiple layers of elastic nets 1 are gradually axially compressed along the mold 2 from two ends toward a central point thereof, as shown in FIG. 2, so that a corrugated ring 3 is formed. To keep the axially compressed elastic nets 1 in the form of the corrugated ring 3, fastening means 4, such as strings and the like, are used to tighten two diametrically opposite points on the corrugated ring 3, as shown in FIG. 4. When the corrugated ring 3 with two diametrically opposite points tightened with strings 4 is removed from the mold 2, outer peripheral portions of the corrugated ring 3 shall, due to an inherent elasticity of the multiple layers of elastic nets 1, automatically spread and finally forms a loosely ruffled bath ball 5 as shown in FIG. 5.

Figure 3:
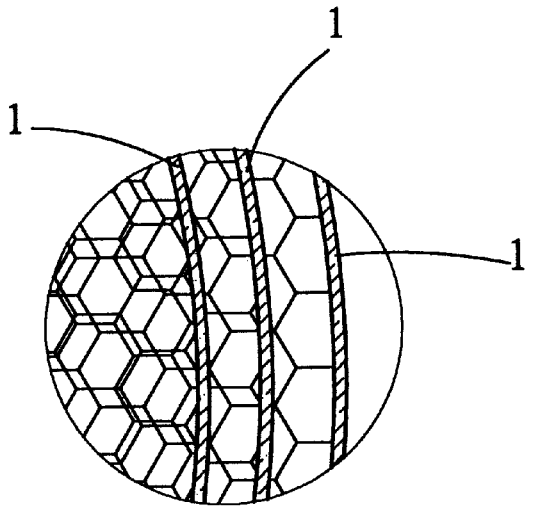
FIG. 3 is a partially enlarged view of FIG. 2 to show the overlapped meshes of the elastic nets.

FIG. 3 is a partially enlarged view of the superposed and axially compressed elastic nets 1 of FIG. 2. As can be clearly seen from the drawing, meshes of the multiple layers of elastic nets 1 overlap one another and thereby define numerous small angular spaces. The multiple layers of the elastic nets 1 give the bath ball 5 increased density, resilience, and softness, while the numerous overlapped, small angular spaces defined by the meshes of the elastic nets 1 enable the bath ball to produce more bubbles from reduced amount of cleansing product. It can be easily understood that there is not any limit to the number of layers of the elastic nets 1. The corrugated ring 3 and the bath ball 5 illustrated in the drawings are only a preferred embodiment of the present invention. Any bath ball formed from two or more layers of the elastic nets 1 shall be included in the scope of the present invention.

Following are some characteristics of the bath ball according to the present invention:

1. The bath ball 5 has largely increased numbers of ruffles and is therefore softer and more resilient for comfortable use. Moreover, the overlapped meshes of the elastic nets 1 enable the bath ball 5 to produce more bubbles from reduced amount of cleansing product.

2. The multiple elastic nets 1 may be in different colors to form a colorful and visually pleasant bath ball 5.

It is to be noted the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A bath ball comprising a plurality of elastic nets woven out of artificial fibers and in a form of long sleeve, said elastic nets having numerous meshes and being sequentially put around a bar-like mold, so that each inner layer of said elastic net on said mold is covered by an outer layer of said elastic net, said elastic nets being then gradually axially compressed into a corrugated ring with said meshes of said a plurality of elastic nets overlapping one another and thereby defining numerous small angular spaces, said corrugated ring being then tightened at two diametrically opposite points with fastening means, and outer peripheries of said corrugated ring automatically widely spreading to from said bath ball when said corrugated ring is removed from said mold; said a plurality of elastic nets giving said bath ball more ruffles so that said bath ball is softer and more resilient for comfortable use, and said numerous small angular spaces defined by said meshes of said elastic nets enabling said bath ball to produce more bubbles from reduced amount of cleansing product.

* * * * *